US006461129B2

(12) United States Patent
Liu

(10) Patent No.: US 6,461,129 B2
(45) Date of Patent: Oct. 8, 2002

(54) SCROLL TYPE COMPRESSOR APPARATUS WITH ADJUSTABLE AXIAL GAP

(75) Inventor: David Liu, Vernon Hills, IL (US)

(73) Assignee: MAT Automotive Inc., Buffalo Grove, IL (US)

( * ) Notice: Subject to any disclaimer, the term of this patent is extended or adjusted under 35 U.S.C. 154(b) by 0 days.

(21) Appl. No.: 09/791,515

(22) Filed: Feb. 23, 2001

(65) Prior Publication Data

US 2002/0119062 A1 Aug. 29, 2002

(51) Int. Cl.[7] ..... F03C 2/00

(52) U.S. Cl. ..... 418/55.2; 418/55.5; 418/57; 418/107

(58) Field of Search ..... 418/55.5, 55.2, 418/57, 107

(56) References Cited

U.S. PATENT DOCUMENTS

| | | | | |
|---|---|---|---|---|
| 3,473,728 A | | 10/1969 | Vulliez | |
| 3,802,809 A | | 4/1974 | Vulliez | |
| 3,874,827 A | | 4/1975 | Young | |
| 4,460,321 A | * | 7/1984 | Terauchi | 418/55.5 |
| 4,540,355 A | | 9/1985 | Sakaki et al. | |
| 4,547,137 A | | 10/1985 | Terauchi et al. | |
| 4,604,039 A | * | 8/1986 | Terauchi | 418/55.5 |
| 4,645,436 A | * | 2/1987 | Sakamoto | 418/55.5 |
| 5,088,906 A | | 2/1992 | Richardson, Jr. | |
| 5,125,810 A | | 6/1992 | Suefuji et al. | |
| 5,192,202 A | * | 3/1993 | Lee | 418/55.5 |
| 5,253,989 A | * | 10/1993 | Shindo et al. | 418/55.2 |
| 5,478,219 A | | 12/1995 | Nardone et al. | |
| 5,641,278 A | | 6/1997 | Tsumagari et al. | |
| 5,807,088 A | | 9/1998 | Fukanuma et al. | |
| 5,829,959 A | | 11/1998 | Tsubono et al. | |
| 5,919,034 A | | 7/1999 | Kawano et al. | |
| 6,059,540 A | | 5/2000 | Ni | |
| 6,129,530 A | | 10/2000 | Shaffer | |
| 6,179,590 B1 | * | 1/2001 | Honma et al. | 418/107 |

FOREIGN PATENT DOCUMENTS

| | | | | |
|---|---|---|---|---|
| JP | 62-111184 | * | 5/1987 | 418/179 |
| JP | 05-079473 | * | 3/1993 | 418/107 |

OTHER PUBLICATIONS

European Abstract, Publication No. 0 557 023 A1, Publication Date Aug. 25, 1993.
Japanese Abstract, Publication No. 07077175, Publication Date Mar. 20, 1995.
Japanese Abstract, Publication No. 07217557, Publication Date Aug. 15, 1995.
Japanese Abstract, Publication No. 08074756, Publication Date Mar. 19, 1996.

(List continued on next page.)

*Primary Examiner*—Thomas Denion
*Assistant Examiner*—Theresa Trieu
(74) *Attorney, Agent, or Firm*—Greer, Burns & Crain, Ltd.

(57) ABSTRACT

A scroll type apparatus for fluid displacement is disclosed. In one embodiment, the apparatus includes an adjustment mechanism capable of being adjusted after assembly of the apparatus to close an axial gap between scroll members and account for manufacturing tolerances in apparatus components. In another embodiment, the apparatus includes an orbital scroll of two portions, with a supporting portion surrounding an eccentric bearing of higher density than that of a scroll portion. The center of mass of the orbital scroll is thus moved towards the eccentric bearing to reduce torquing of the scroll as it orbits. In a further embodiment, the apparatus includes an orbital scroll having two portions, a supporting portion surrounding an eccentric bearing having a lower coefficient of thermal expansion than that of a scroll portion, to reduce thermal expansion of the supporting portion, reducing misaligmnent of the eccentric orbital scroll on the bearing.

15 Claims, 7 Drawing Sheets

OTHER PUBLICATIONS

Japanese Abstract, Publication No. 08093667, Publication Date Apr. 9, 1996.
Japanese Abstract, Publication No. 08232858, Publication Date Sep. 10, 1996.
Japanese Abstract, Publication No. 08247049, Publication Date Sep. 24, 1996.
Japanese Abstract, Publication No. 10110689, Publication Date Apr. 28, 1998.
Japanese Abstract, Publication No. 10176681, Publication Date Jun. 30, 1998.
Japanese Abstract, Publication No. 10339283, Publication Date Dec. 22, 1998.
Japanese Abstract, Publication No. 11093863, Publication Date Apr. 6, 1999.

* cited by examiner

SCROLL TYPE COMPRESSOR APPARATUS WITH ADJUSTABLE AXIAL GAP

BACKGROUND OF THE INVENTION

The present invention relates generally to fluid displacement devices, such as scroll compressors, and more particularly, to an improved scroll type compressor that maintains axial sealing between fixed and orbital scrolls, and maintains perpendicularity of the scrolls to an axis of a shaft driving the compressor.

Scroll type fluid displacement apparatuses, such as scroll compressors, are well known for quietly and efficiently displacing fluid, often from an expanded state to a compressed state, or vice versa. Such devices are increasingly common in systems such as automobile air conditioners.

One such scroll type apparatus is shown in U.S. Pat. No. 3,874,827 to Young, which is incorporated herein by reference. The '827 patent discloses interfitting spiroidal wraps of two scroll members, which are angularly and radially offset to define one or more moving fluid chambers. By causing one of the scroll members to orbit relative to the other, the apparatus moves the fluid chambers along ribs of the scrolls to change their volume and thus compress or expand the fluid within the chambers.

Until recently, the concept disclosed by Young has not been commercially viable because the machining technology has not been sufficiently sophisticated to produce the curved scroll blades to the required tolerances. If the blades of the moving and fixed scrolls are not machined within required tolerances, fluid leaks and inefficient operation will result.

An axial gap between the scroll members must be sufficiently small (typically less than 0.01 mm) so that an undesirable amount of fluid does not escape. The axial gap between the scroll members is created by, among other things, tolerances in manufacturing of the components of the apparatus. These components must be precisely manufactured and finished to limit such tolerances, which adds to manufacturing costs. However, even small tolerances among various components accumulate to increase the axial gap.

In addition, the scroll members must remain perpendicularly oriented to an axis of a shaft driving orbital movement of the scroll members. Otherwise, axial gaps arise at various contact points between the scroll members, particularly as they move. Also, the scroll members can become misaligned during operation due to manufacturing tolerances, among other reasons. Misalignment of the scroll members also results in accelerated wear of the apparatus components.

The '827 patent attempts to maintain axial sealing by using a high-pressure fluid porting system with a compliant attachment disk. However, the '827 patent does not adequately account for manufacturing tolerances within the components of the displacement apparatus, nor does it sufficiently account for maintaining perpendicularity of the scrolls to the axis of the shaft that drives the apparatus.

It is an object of the present invention to provide an improved fluid displacement apparatus, such as an improved scroll compressor, that minimizes an axial gap between first and second scroll members to improve compression efficiency.

It is a further object of the invention to provide an improved fluid displacement apparatus, such as an improved scroll compressor, having an axial gap that can be reduced after assembly of the compressor.

It is a further object of the present invention to provide an improved fluid displacement apparatus, such as an improved scroll compressor, that helps to maintain perpendicularity between the scroll marks and an axis of rotation, to improve compression efficiency and to reduce wear of the compressor.

SUMMARY OF THE INVENTION

The present invention overcomes the shortcomings of the prior art by providing an improved scroll type fluid displacement apparatus, particularly a compressor, that maintains axial sealing between fixed and orbital scrolls to increase operation efficiency. The present invention also helps maintain perpendicularity between the scrolls and the shaft axis, increases balance of operation of the apparatus, and reduces operational wear of the apparatus.

In a first embodiment, the improved scroll type fluid displacement apparatus includes: a housing, a first, fixed scroll having a first base and a first rib portion and a second, orbital scroll having a second base and second rib portions, the rib portions of the first scroll and second scroll being radially and phase-shifted relative to one another to contact in a plurality of points to define, with the base of the first and second scrolls, at least one fluid chamber. Also included is an adjustable mechanism for exerting pressure to and between the first and second scrolls to reduce an axial gap between opposing portions of the first scroll and the ribs of the second scroll, to keep the axial gap less than a defined amount for axial sealing of the fluid chamber.

Preferably, the adjustment mechanism includes at least three equidistant adjustment fasteners engaging corresponding bores, which extend axially through the housing. These fasteners can preferably be adjusted after assembly of the apparatus. In a further preferred embodiment, the fasteners are disposed within the apparatus to contact and load bosses contained on a thrust bearing that is included to resist axial thrust between the scrolls.

In another embodiment, the improved scroll type fluid displacement apparatus includes an orbital scroll having at least two portions of significantly different densities. The preferably bimetallic orbital scroll includes a hub or supporting portion surrounding the eccentric bearing having significantly greater density than a connected or integrally formed scroll portion. As a result, the center of mass of the orbital scroll is located at or near the supporting portion. This feature maintains the orbital balance of the second scroll, and thus maintains the perpendicularly of the orbital scroll to the axis of rotation.

In yet another embodiment, the supporting portion of the orbital scroll is manufactured of a material having a lower thermal expansion coefficient than that of the scroll portion. By reducing expansion of the supporting portion surrounding the eccentric bearing, misalignment of the orbital scroll relative to the eccentric bearing is reduced, thus maintaining perpendicularity of the orbital scroll to the axis of rotation and reducing total indicator runout.

DETAILED DESCRIPTION OF THE INVENTION

In the following description, the term "scroll compressor" is used to refer to an exemplary embodiment of the inventive apparatus. It is important to appreciate, however, that the principles described herein are applicable to, among other things, any scroll type apparatus for fluid displacement, and nothing described herein should be taken as limiting the scope of the present invention to a scroll compressor.

Figure 1:
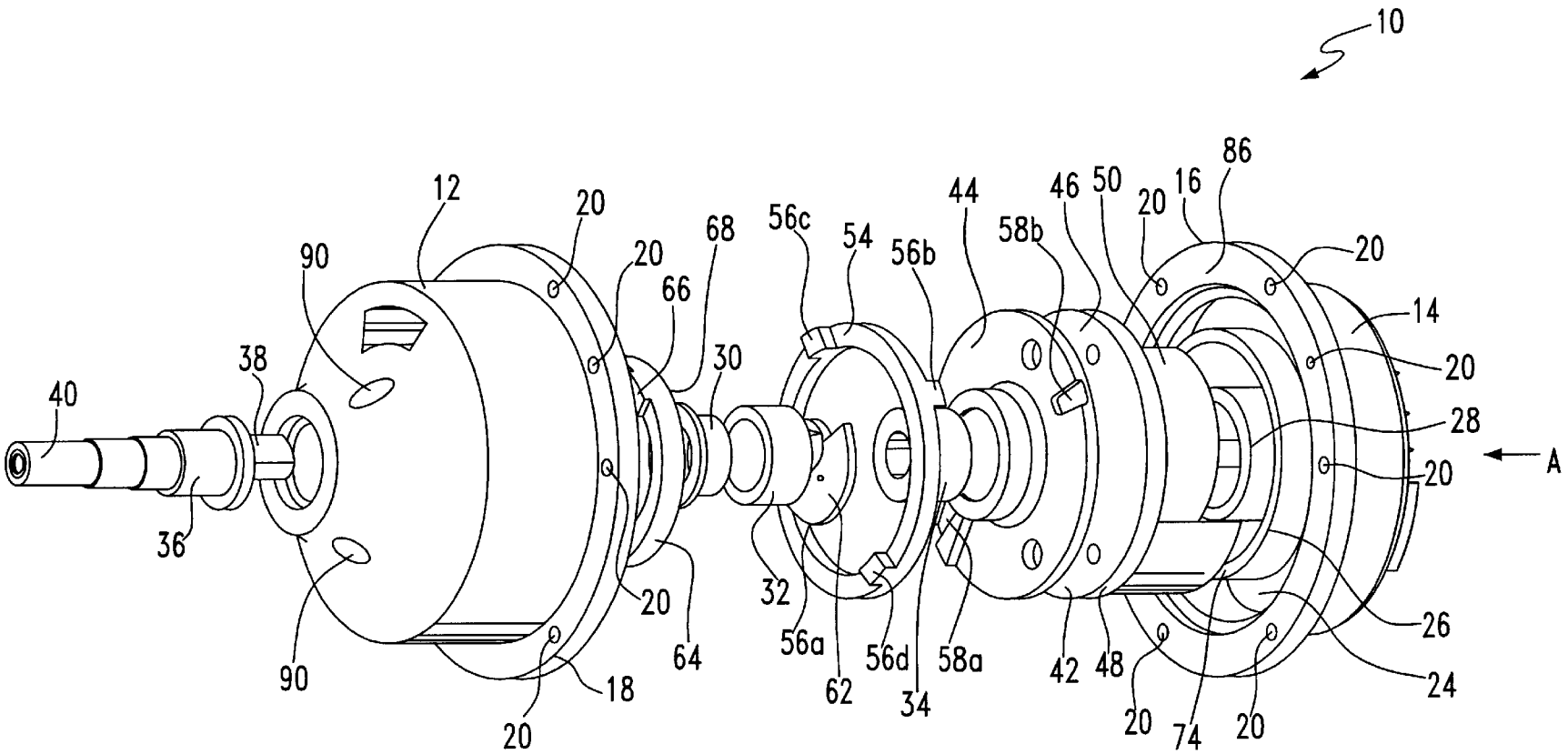
FIG. 1 is an exploded perspective view of a scroll type fluid displacement apparatus in accordance with one embodiment of the present invention.
Figure 3:
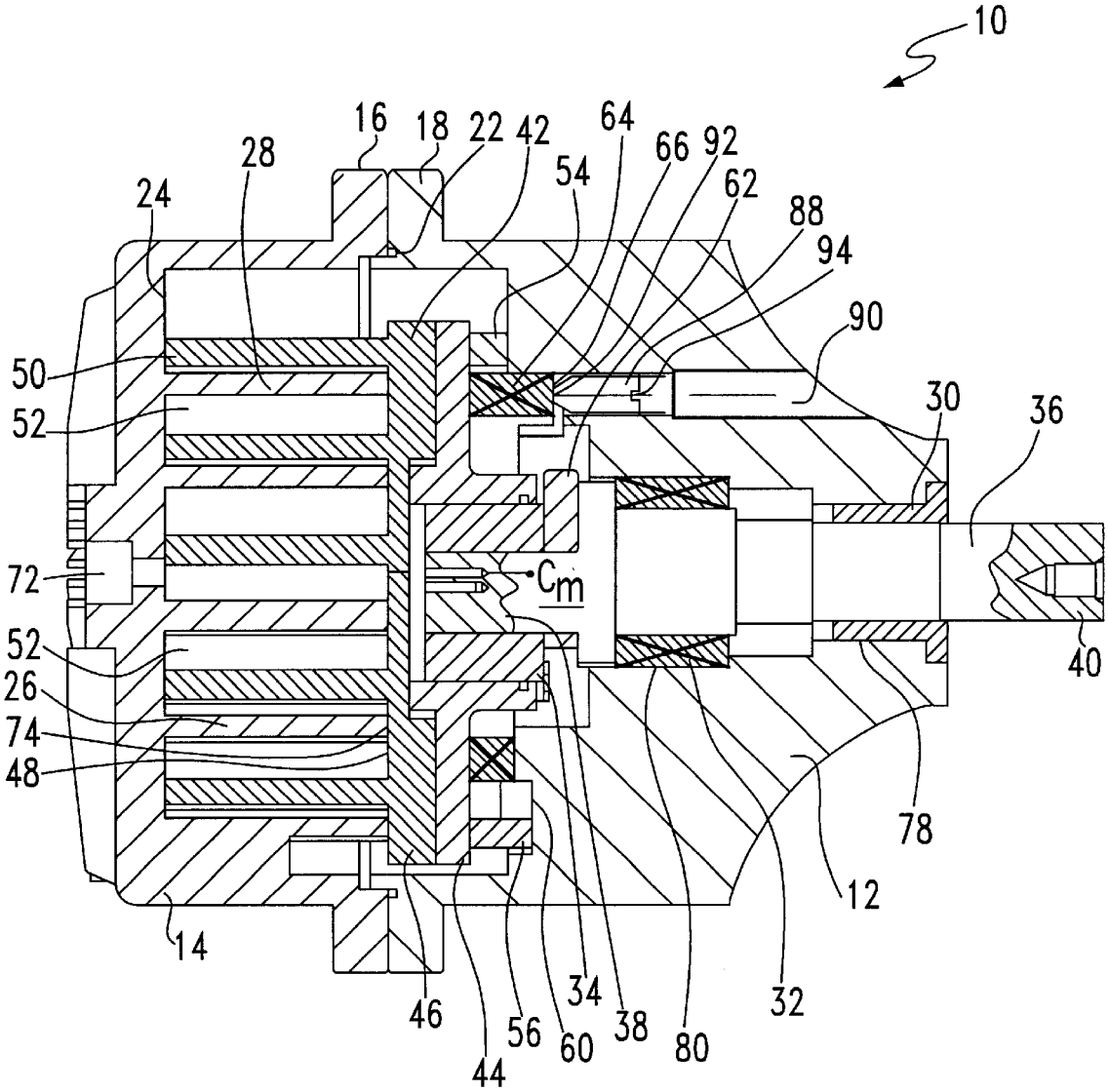
FIG. 3 is a cross-sectional view of the apparatus of FIG. 1, as assembled, taken along line 3—3 of FIG. 2, and in the direction generally indicated.
Figure 4:
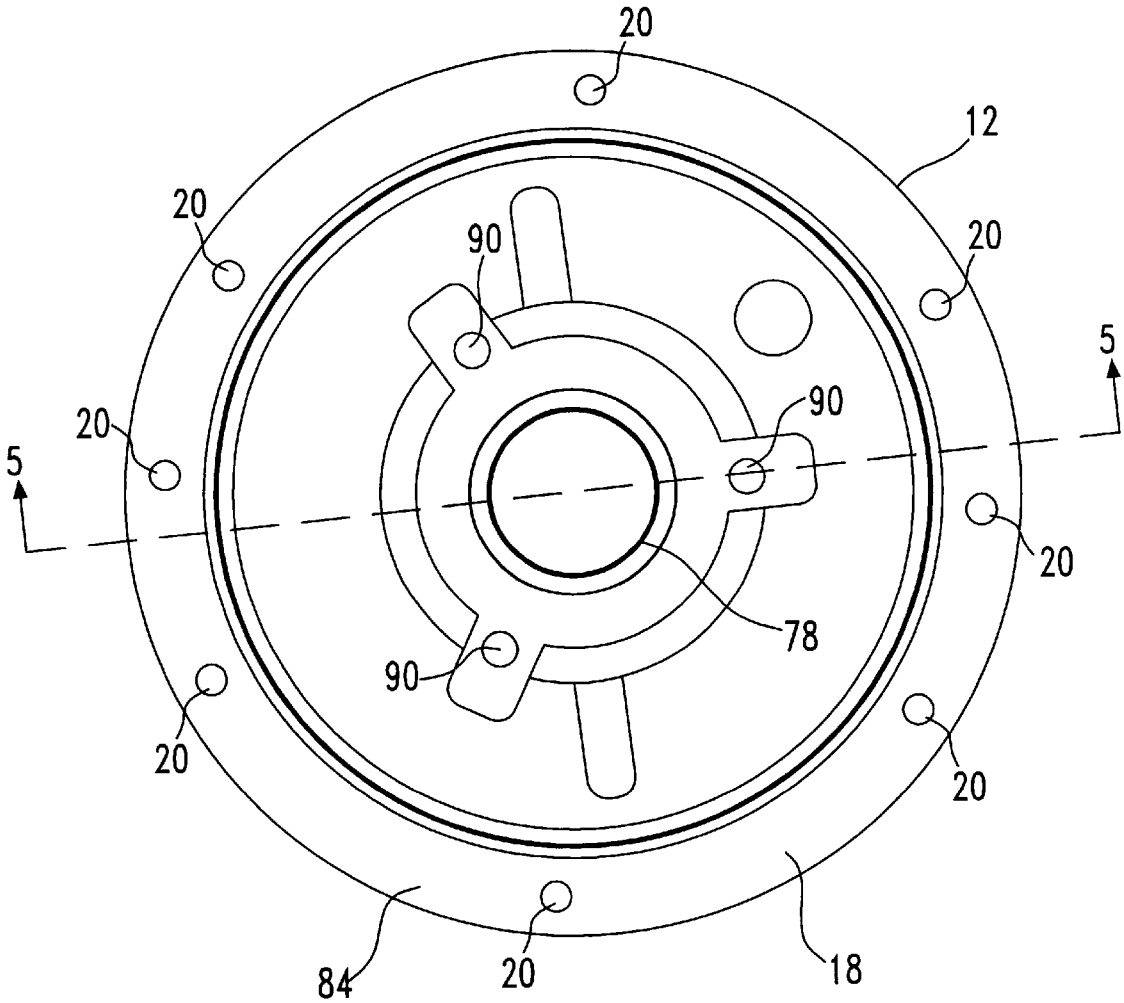
FIG. 4 is a plan view of the housing for the apparatus of FIG. 1, from inside the apparatus.

Referring now to FIGS. 1 and 3, a scroll compressor according to one embodiment of the present invention is indicated generally at 10. A housing 12 and a first, typically fixed scroll 14 are included in the compressor 10. The fixed scroll 14 includes an outer flange portion 16, which abuts and attaches to a matching flange 18 on the housing 12 to enclose inner portions of the compressor 10 when assembled, as seen in FIG. 3. A plurality of spaced bores 20 are disposed about the outer flange 16 of the fixed scroll 14 and are aligned with similar bores 20 in the outer flange 16 of the housing 12, to allow fasteners, such as screws (not shown) to connect the flanges 16, 18 to enclose the compressor 10. An elastomeric ring, such as an O-ring 22, is provided at the junction of the flanges 16, 18 to help seal the housing flange 18 against the fixed scroll flange 16.

Also included on the fixed scroll 14 is a base portion 24 and a profile portion 26 extending normally from the base portion, the rib portion including a profile 28 being formed in a spiral pattern or other known scroll pattern, such as an involute of a circle. The profile 28 is attached to the base portion 24, and is preferably integrally formed therewith, however other types of attachments (ultrasonic or other welding, adhesive, etc.) are contemplated.

A number of bearings, including a front bearing 30, a middle bearing 32, and an eccentric bearing 34, are housed within the compressor 10. A shaft 36 runs through the center of the housing 12 for driving the compressor 10. Mounted within the bearings 30 and 32, the shaft 36 rotates about a central axis. The eccentric bearing 34 mates with an eccentric 38 at an end of the shaft 36 for converting axial rotation of the shaft to orbital movement. The eccentric bearing 34 is surrounded by, and supports, an orbital scroll 42 to allow orbital movement of the orbital scroll on the eccentric bearing. As is known in the art, the shaft 36 is coupled to a pulley (not shown) placed on the shaft end 40, for rotatably driving the shaft.

Included on the orbital scroll 42 is a hub or supporting portion 44 (seen more clearly in FIG. 8), which is supported by the eccentric bearing 34, and a scroll portion 46, which further includes a base 48 and a profile 50. Extending outwardly from the base 48, the profile 50 is shaped in a spiral pattern similar to the fixed scroll profile 28.

As is well known in the art, the profiles 28 and 50 are assembled together within the compressor 10 in radially offset and phase-shifted positions relative to one another to create a plurality of contact points, which in combination with the bases 24, 48 define a plurality of fluid chambers 52. Rotation of the shaft 36 within the eccentric bearing 34 drives orbital movement of the orbital scroll 42, which shifts the fluid chambers 52 toward the center of the interengaged spiral profiles 28 and 50, while decreasing the volume of the fluid chambers and thus compressing the fluid therein. This general fluid displacement principle is explained in U.S. Pat. No. 3,874,827 to Young, which is herein incorporated by reference.

A knuckle ring 54 prevents rotation of the orbital scroll 42 relative to the housing 12. Bosses 56*a–d* engage corresponding slots 58*a*, 58*b* in the orbital scroll supporting portion 44 and slots 60*a*, 60*b* in the housing 12, respectively. Other known devices may be used for this purpose. A balancer 62 offsets the centrifugal force resulting from rotational operation of the eccentric 38 to reduce operational vibration of the compressor 10.

Figure 9:
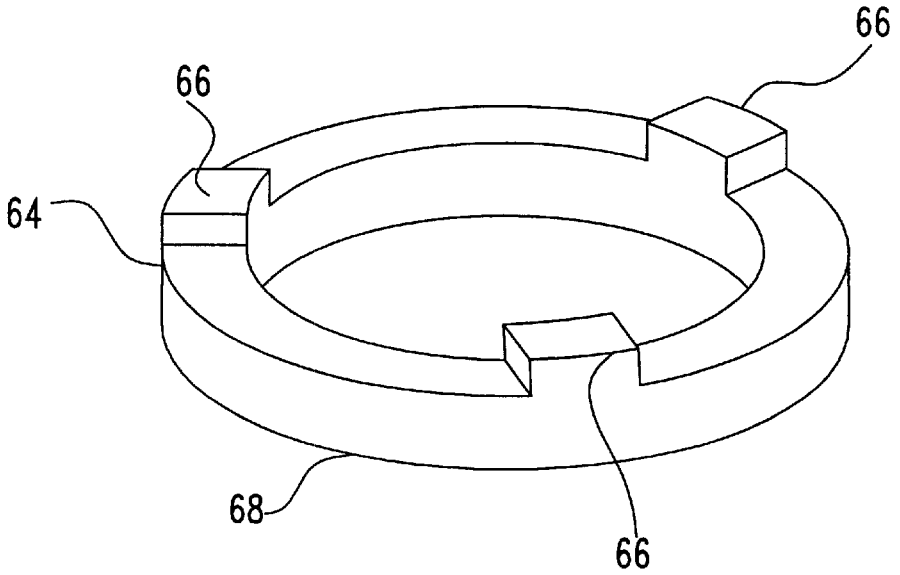
FIG. 9 is a perspective view of a thrust bearing used in the apparatus of FIG. 1.

Referring now to FIGS. 3 and 9, a thrust bearing 64 rests within the housing 12 and resists axial pressure resulting from axial thrust generated as compressed fluid attempts to separate the fixed scroll 14 from the orbital scroll 42. The thrust bearing 64 preferably includes a plurality of integral bosses 66 which are preferably integrally formed with and project axially from the bearing. Manufacturing tolerances of the bearing 64 contributing to an axial gap between scrolls 14 and 42 include: the thickness of the thrust bearing and the flatness of a thrust bearing surface 68 and its perpendicularity to the axis of the shaft 36.

Figure 2:
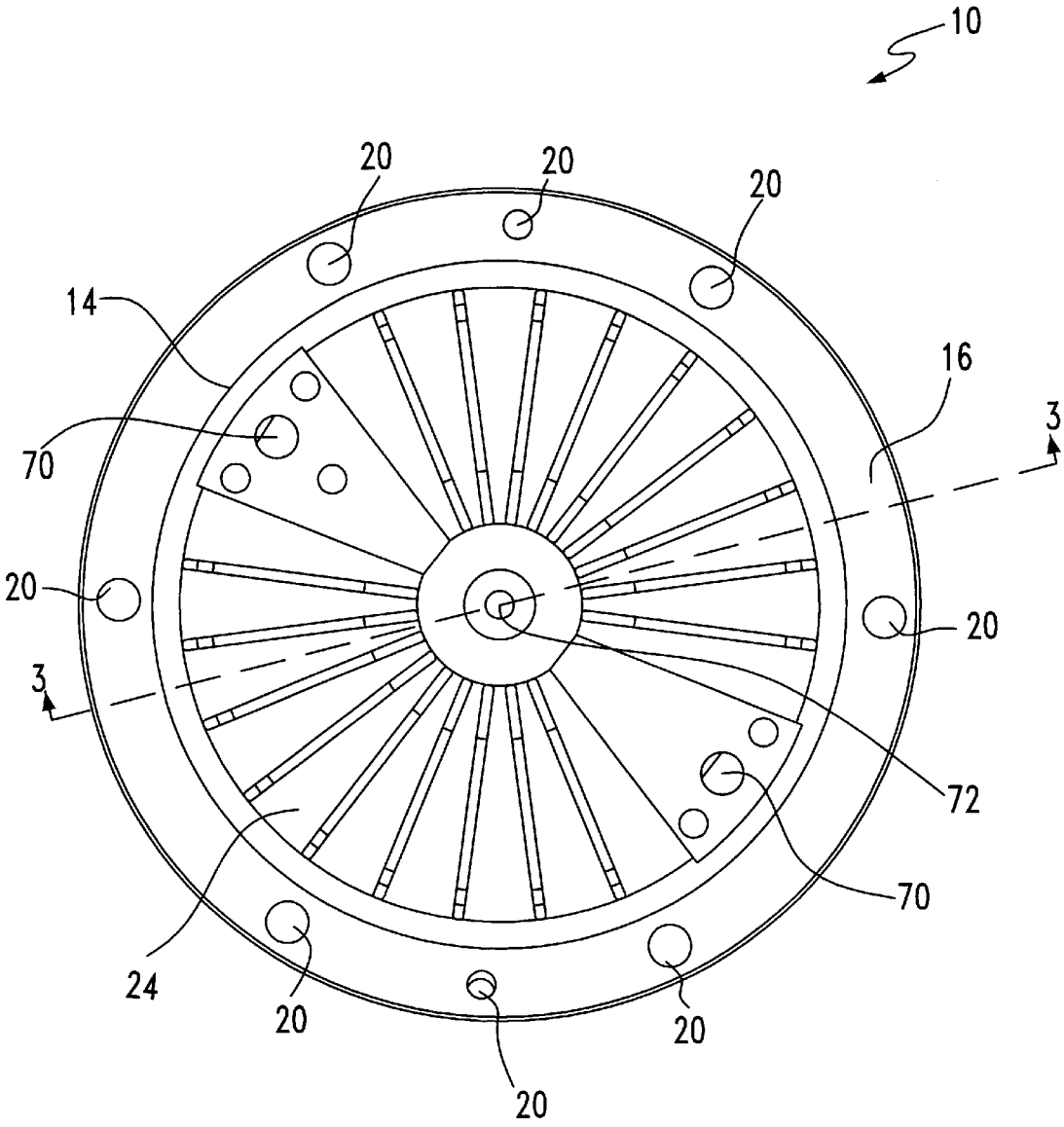
FIG. 2 is a plan view A of the apparatus of FIG. 1.

Referring now to FIG. 2, a plan view of one end of the scroll compressor 10 shows the outer surface of the fixed scroll base portion 24. Inlet ports 70 allow fluid to enter the radially outermost chambers 52 formed by the profiles 28 and 50. Compressed fluid exits the compressor 10 via an outlet port 72 disposed at the center of the base 24.

To optimize compression efficiency, the fixed scroll 14 and the orbital scroll 42 must be as close together axially as possible, otherwise the axial gap between the scrolls allows an undesirable amount of fluid to escape. As shown in FIG. 3, an outer surface 74 of the fixed scroll profile portion 26 appears to be flush against the orbital scroll base 48. Similarly, the outer surface 76 of orbital scroll profile 50 appears to be flush against the fixed scroll base 24. This is an optimal position.

However, an axial gap between the aforementioned surfaces and bases invariably exists due to aggregation of manufacturing variations from the desired tolerances as the component parts are manufactured, including the housing 12, the fixed scroll 14, the orbital scroll 42, and the thrust bearing 64. Tolerances in the thrust bearing 64 have previously been described herein. Tolerances in manufacturing of housing 12 affecting the axial gap include at least: axial position of a support 78 for the front bearing 30; the axial position of a support 80 for middle bearing 32; the depth of a thrust surface 82; the flatness of the thrust surface and its perpendicularity to the axis of the shaft 36; the depth of a surface 84 of the flange 18; and the flatness of the flange surface and its perpendicularity to the axis of the shaft 36.

Figure 6:
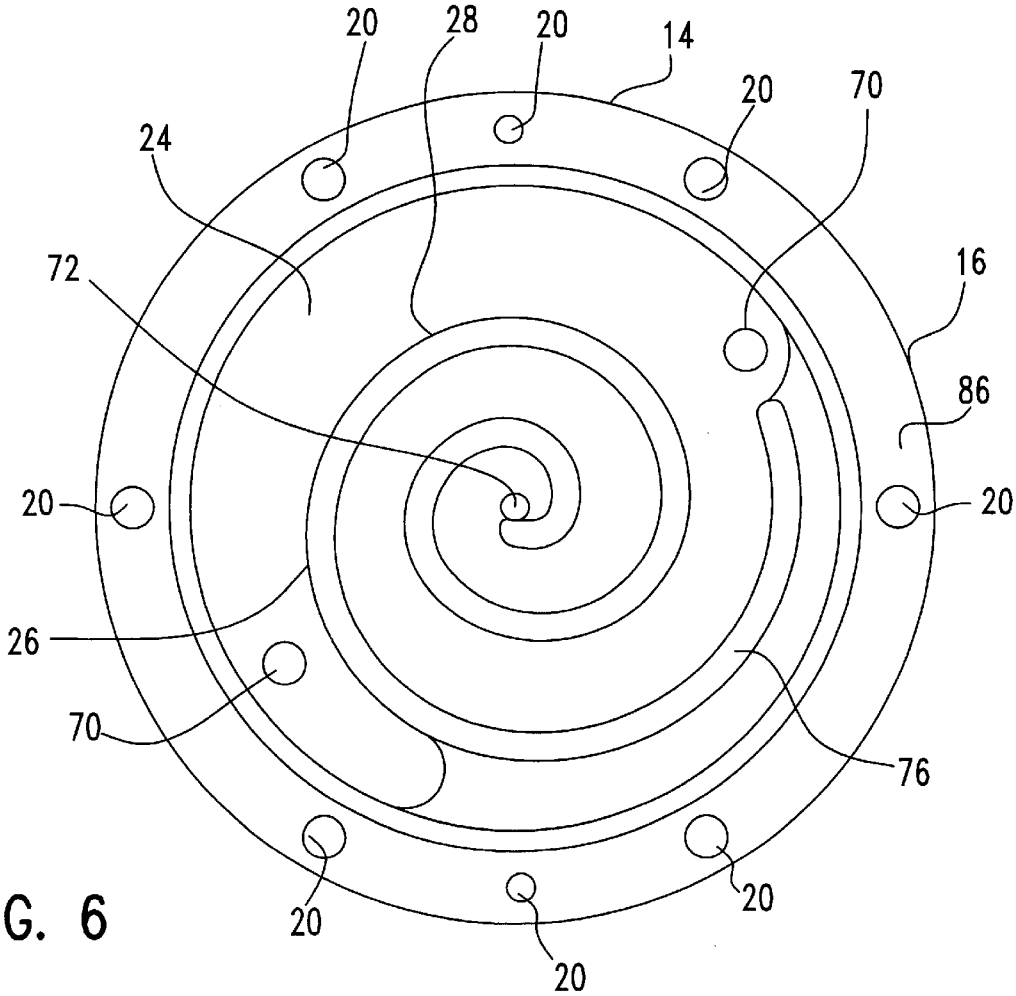
FIG. 6 is a plan view of a fixed scroll member for the apparatus of FIG. 1.
Figure 7:
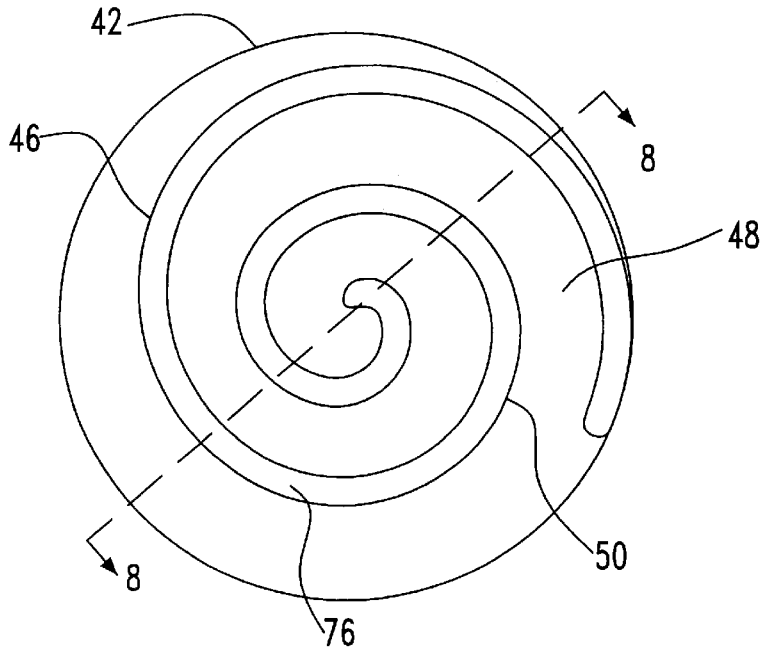
FIG. 7 is a plan view of an orbital scroll for the apparatus of FIG. 1.
Figure 8:
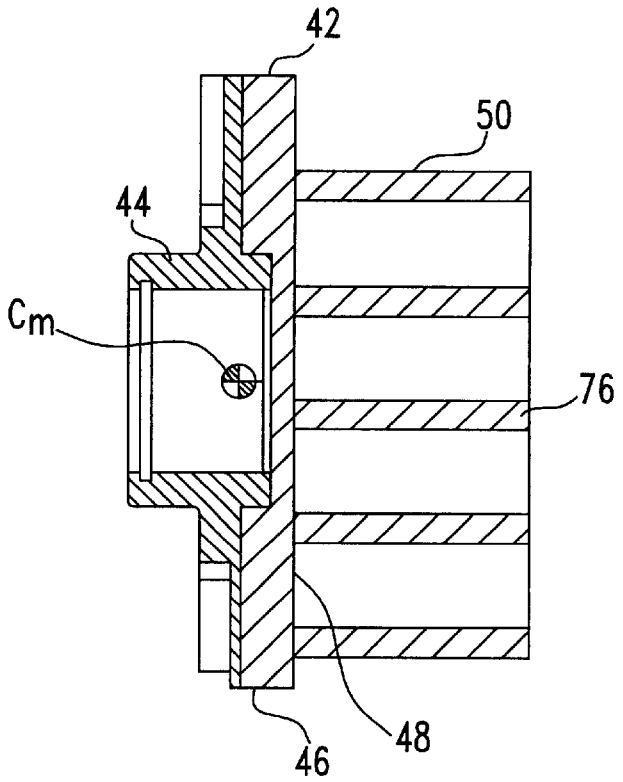
FIG. 8 is a cross-sectional view of the orbital scroll taken along line 8—8 of FIG. 7.

Referring now to FIGS. 6–8, manufacturing tolerances affecting the axial gap include: the depth of a surface 86 of the flange 16; the flatness of the flange surface and its perpendicularity to the axis of shaft 36; and the height (extension) of the profile 28, as well as the condition and finish of the surface of the profile. Mechanical tolerances in the orbital scroll 42 contributing to the axial gap include: the height (or depth) of the profile 50 as well as the condition and finish of the surface of the profile; and, the overall dimension from the profile 50 to the thrust surface 82.

The aggregation of at least these manufacturing tolerances contributes to the axial gap between fixed scroll 14 and orbital scroll 42. To reduce this axial gap, and thus to account for several of these tolerances, the present invention provides an adjustment mechanism that exerts pressure to and between the fixed scroll 14 and the orbital scroll 42. Preferably, this mechanism is embodied in a plurality of adjustment fasteners, which are preferably threaded screws 88 (see FIG. 3) extending through a plurality of through-bores 90 disposed in and extending through the housing 12. Preferably, the three screw bores 90 are equidistantly disposed on the housing 12 and also axially aligned with the bosses 66 of the thrust bearing 64.

It is strongly preferred that at least three equidistant screws 88 are included for an even reduction of the axial gap across the compressor 10. As seen in FIG. 3, adjustment screws 88 contained within the bores 90 contact and axially load the bosses 66 of the thrust bearing 64 at an inner end 92. Preferably, the screw bores are positioned within housing 20 so that a second end 94 can be accessed with an adjusting instrument, such as a screwdriver, inserted into the bore 90 to tighten the screws 88 after assembly of the compressor 10. With the inventive adjustment mechanism, a manufacturer of the compressor 10 can adjust for manufacturing tolerances and thus close the axial gap without having to reconfigure manufacturing tolerances for individual components of the compressor during a manufacturing run.

The axial pressure from the screws 88 in turn is transmitted from the bosses 66 to the orbital scroll 42 via the supporting portion 44, sandwiching the orbital scroll between the thrust bearing 64 and the fixed scroll 14. The pressure from the screws 88 axially urges the orbital scroll 42 towards the fixed scroll 14, and more particularly urges the orbital scroll profile surface 76 toward the fixed scroll base 24 and the orbital scroll base 48 towards the fixed scroll profile surface 74. If at least three substantially coplanar adjustment members 88 are included, the operator can evenly reduce the axial gap by providing axial pressure (or varying the pressure as needed) along the shaft axis. This helps maintain the parallelism of the orbital scroll 42 to the fixed scroll 14, thus reducing loss of fluid as the orbital scroll moves. The axial pressure thus evenly closes the axial gap between the scrolls, axially sealing the fluid chambers and improving compression efficiency.

After assembly of the compressor 10, an operator determines the present axial gap between scrolls 30, 60 and/or the resulting compression, via known methods, such as rotating the shaft 36 to determine if resistance exists due to friction between the profiles 28, 50 and bases 24, 48 of the scrolls. The operator tightens the adjustment screws 88 to exert pressure on the thrust bearing bosses 66 until the axial gap is within a recommended tolerance for optimal compression.

Figure 5:
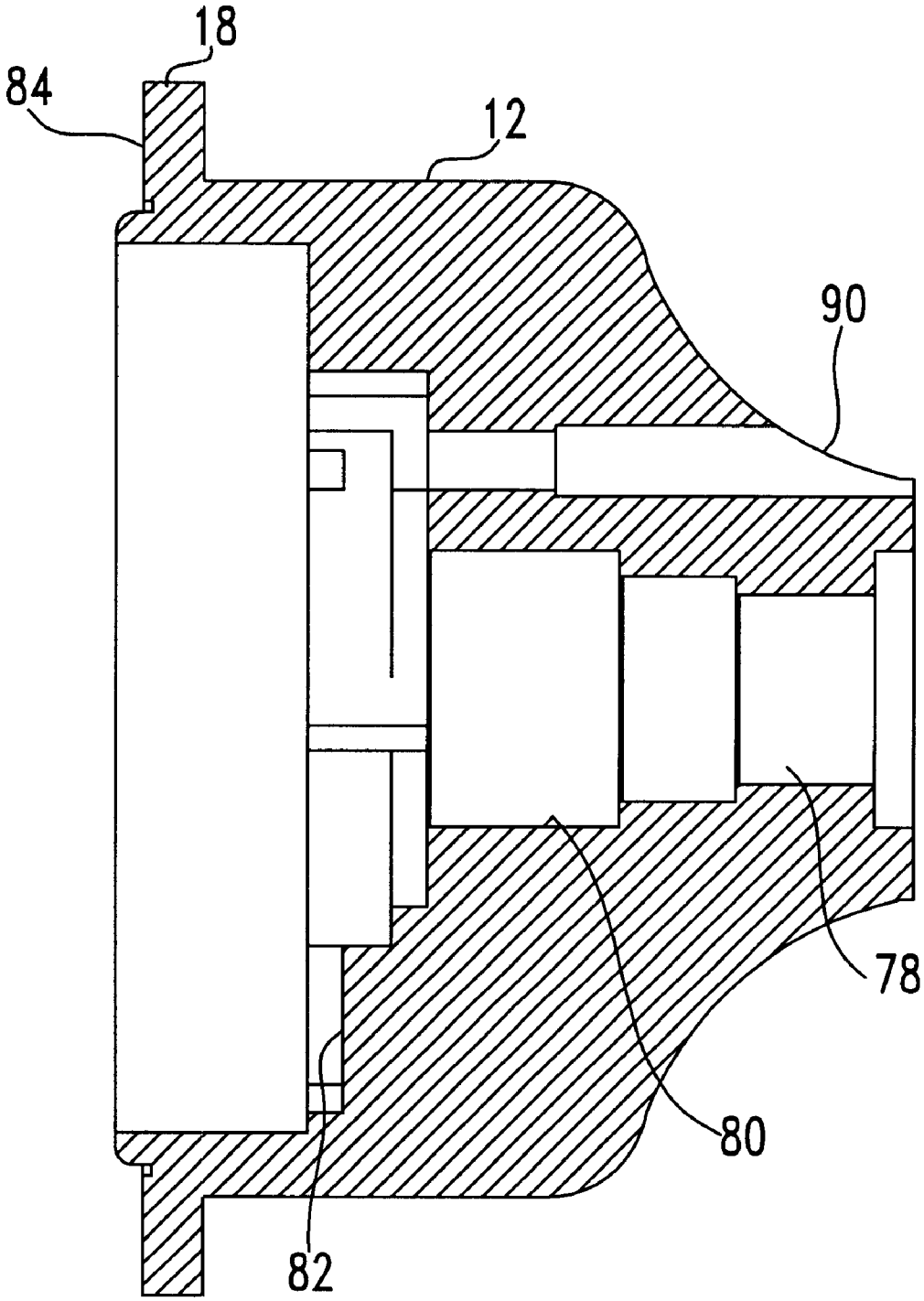
FIG. 5 is a cross-sectional view of the housing taken along line 5—5 of FIG. 4, and in the direction indicated generally.

The present adjustment mechanism allows an assembler to fine-tune the compressor after assembly, overcoming several of the manufacturing variances found in the compressor components, and mentioned previously. For example, with the housing 12 (best seen in FIG. 5), a manufacturer can at least partially account for tolerances in the depth, flatness, and perpendicularity of the thrust surface 82. With the thrust bearing 64 (best seen in FIG. 9), a manufacturer can at least partially account for tolerances in the thickness of the bearing 64 and the flatness of the bearing surface 68 as well as its perpendicularity to the axis of the shaft 36. With the fixed scroll 14, a manufacturer can at least partially account for tolerances in the depth of the flange surface 86. With the orbital scroll 42, a manufacturer can at least partially account for tolerances in the overall dimension from the scroll to the thrust surface 68. The inventive adjustment mechanism may correct other variances, as well. By reducing the number of critical tolerances in manufacturing the component parts of the compressor 10, the cost of manufacturing and/or machining the compressor is greatly reduced.

To further minimize the axial gap between the scrolls, a second principal aspect of the present invention includes manufacturing the orbital scroll 42 from a plurality of materials having varying densities. In a preferred embodiment, the supporting portion 44 of the orbital scroll 42 is manufactured of a material having a density significantly higher than that of the scroll portion 46 (including the base 48 and the profile 50).

Preferably, the ratio of the density of the supporting portion 44 to that of the scroll portion 46 is at least 2. For example, if the supporting portion 44 is manufactured of ductile iron, and the scroll portion 46 is manufactured of aluminum (which is preferred), the supporting portion is approximately 2.7 times as dense as the scroll portion. Of course, other materials are possible for making the portions 44, 46 of the orbital scroll 42; for example, steel or cast iron for the supporting portion. The supporting portion 44 and the scroll portion 46 may be assembled in any manner known in the art, including but not limited to forming the orbital scroll 42 as one integral part, gluing, welding, casting, fastening, etc.

By constructing the orbital scroll 42 from materials of two distinct densities, the center of mass Cm (best seen in FIG. 8) for the compressor is moved towards, and preferably within, the area of eccentric bearing 34, which supports the orbital scroll 42. In prior art compressors, having a single material for the orbital scroll 42 (or multiple materials of similar density), the center of mass Cm may be significantly offset from the orbital scroll support, such as within the area of the profile 50 of the orbital scroll 42.

As air is compressed between the scrolls 14, 42 during operation of the compressor 10, it exerts a thrust force against the orbital scroll, as it attempts to separate the scrolls. If the center of mass Cm is offset from the supporting portion 44 of the orbital scroll 42, as in existing compressors, this thrust produces imbalance at the supporting portion, which can cause the orbital scroll to tilt, and thus deviate from a desired perpendicularity with the shaft axis. This undesirable result misaligns the scrolls 14, 42, increases the axial gap between the scrolls, and increases wear on the compressor 10.

By moving the center of mass Cm towards or within the area of the eccentric bearing 34 supporting the orbital scroll 42 for rotation, the rotation is substantially more balanced, and parallelism between the scrolls can be maintained, even as fluid between the scrolls is compressed.

The use of these various materials provides the additional benefit of allowing a tighter bearing seating between the orbital scroll 42 and the eccentric bearing 34. Aluminum scrolls tend to contract in manufacturing. However, in existing compressors, orbital scrolls manufactured entirely of aluminum expand around the eccentric bearing 34 as the scroll heats up during rotation of the scroll (which can rotate at 1000–5000 rpm). This expansion results in loosening of the portion supporting 44 surrounding the bearing, and thus may cause misalignment of the scroll on the bearing (total indicator runout). This misalignment increases portions of a radial gap between the scrolls, particularly when the center of mass Cm is offset from the area of the supporting bearing. Compression efficiency therefore decreases.

In the present invention, because iron (for example) has a much lower coefficient of thermal expansion than aluminum, the supporting portion 44 does not expand nearly as greatly about the eccentric bearing 34, allowing the orbital scroll 42 to remain tighter around the eccentric bearing 34, thus reducing misalignment of the scrolls. Any expansion in the aluminum scroll portion 46 due to increased scroll temperature is offset by the expansion of aluminum in the fixed scroll 14, so that the radial and axial gaps do not deviate significantly.

From the foregoing description, it should be understood that an improved scroll type fluid displacement apparatus has been shown and described, which has many desirable attributes and advantages. By providing an adjustment mechanism that can be used to close the axial gap between scrolls after assembly of the fluid displacement apparatus, the number of precise manufacturing tolerances for components of the member can be reduced, resulting in lower manufacturing costs. The use of at least three adjustment members in the mechanism retains the perpendicularity of the orbital scroll to the fixed scroll, providing a balanced apparatus and a more closely maintained axial gap. Also, by providing a bimetallic orbital scroll as described, the inventive fluid displacement apparatus retains the benefits of aluminum rib and base portions (light for easier rotation, thermal expansion with the aluminum fixed scroll, etc.) while bringing the center of mass to the area of the portion of the scroll that is supported by the eccentric bearing. In addition, thermal expansion between supporting portion and bearing is reduced, which prevents loosening between the scroll and the bearing, and thus reduces excessive vibration. This in turn prevents damage to the bearing and increases the bearing life.

While a particular embodiment of the present scroll type fluid displacement apparatus has been shown and described, it will be appreciated by those skilled in the art that changes and modifications may be made thereto without departing from the invention in its broader aspects and as set forth in the following claims.

What is claimed is:

1. A scroll type apparatus for fluid displacement, comprising:

a housing, said housing including a plurality of bores, each of said bores extending axially through a portion of said housing;

a first scroll having a base and rib portions;

a second scroll having a second base and second rib portions, said rib portions of said first scroll and second scroll being radially and phase-shifted relative to one another to contact in a plurality of points to define, with said base of said first and second scrolls, at least one fluid chamber; an adjustable mechanism for exerting pressure to and between said first scroll and second scroll to reduce an axial gap between opposing portions of said first scroll and said ribs of said second scroll, to keep said axial gap less than a defined amount for axial sealing of said fluid chamber;

a thrust bearing disposed within and supported by the housing, said trust bearing being adapted to withstand axial thrust generated by movement of said compressed fluid in said fluid chamber as said second scroll orbits, said thrust bearing including a plurality of bosses extending axially from a surface of the thrust beating; and an adjustable mechanism extending through said bores to exert axial pressure against said plurality of bosses, and thus reduce an axial gap between opposing portions of said first scroll and said second scroll to keep said axial gap less than a defined amount for axial sealing of said fluid chamber.

2. The apparatus of claim 1 wherein said adjustable mechanism is configured such that said pressure exerted by said adjustable mechanism is adjustable after assembly of the apparatus.

3. The apparatus of claim 1 wherein said adjustable mechanism comprises at least three adjustment fasteners disposed axially through a portion of said housing.

4. The apparatus of claim 3 wherein each of said bores is configured to accommodate one of said plurality of adjustment fasteners.

5. The apparatus of claim 4 wherein said plurality of bores are disposed along an outer surface of said housing substantially equidistant from one another.

6. The apparatus of claim 4 wherein each of said bores is threaded to accommodate one of said adjustment fasteners.

7. The apparatus of claim 1 wherein said plurality of bosses are disposed along said surface substantially equidistant from one another.

8. The apparatus of claim 7 wherein said bosses are disposed along said thrust bearing surface to be axially aligned with said plurality of bores such that said adjustment fasteners can extend through said bores to contact said bosses to exert axial pressure against said bosses.

9. The apparatus of claim 7 wherein said adjustment fasteners extend axially through said housing to contact said bosses, thus exerting axial pressure on said bosses to adjustably reduce said axial gaps between said first and second scrolls.

10. The apparatus of claim 3 wherein each of said adjustment fasteners comprise screws.

11. A scroll type apparatus for fluid displacement, comprising:

a housing, said housing including a plurality of bores, each of said bores extending axially through a portion of said housing;

a first scroll having a base and rib portions;

a second scroll having a second base and second rib portions, said rib portions of said first scroll and second scroll being shifted relative to one another to contact in a plurality of points to define, with said base of said first and second scrolls, at least one fluid chamber;

a bearing disposed within the housing, said bearing including a plurality of bosses extending axially from said bearing and axially toward said plurality of bores, said bosses of said bearing being aligned with said bores; and a plurality of adjustment fasteners extending through said bores and in contact with said bosses to exert selective axial pressure against said bosses to reduce an axial gap between said first scroll and said second scroll.

12. The apparatus of claim 11 wherein said bosses are disposed along said bearing substantially equidistant from one another.

13. The apparatus of claim 11 wherein said bosses are integrally formed with said bearing.

14. The apparatus of claim 11 wherein said bearing is a thrust bearing configured to withstand axial thrust generated by movement of said compressed fluid in said fluid chamber as said second scroll orbits.

15. A scroll type apparatus for fluid displacement, comprising:

a housing having a plurality of axially extending bores;

a first scroll having base and rib portions;

a second scroll having a base and second rib portions, said rib portions of said first scroll and second scroll being shifted relative to one another to contact in a plurality of points to define, with said base of said first and second scrolls, at least one fluid chamber;

a shaft for driving said second scroll member into orbital movement relative to said first scroll member to move said fluid chamber;

a bearing disposed within said housing having a surface and a plurality of bosses extending axially from said surface and toward said bores of said housing, said bosses being axially aligned with said bores; and an adjustment mechanism extending through said bores and configured to contact said bosses of said bearing to axially load said bosses.

* * * * *